US008961670B2

(12) United States Patent
Bera et al.

(10) Patent No.: US 8,961,670 B2
(45) Date of Patent: Feb. 24, 2015

(54) ALKALINE PLATING BATH FOR ELECTROLESS DEPOSITION OF COBALT ALLOYS

(71) Applicant: Atotech Deutschland GmbH, Berlin (DE)

(72) Inventors: Holger Bera, Berlin (DE); Heiko Brunner, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/376,657

(22) PCT Filed: Jan. 9, 2013

(86) PCT No.: PCT/EP2013/050287

§ 371 (c)(1),
(2) Date: Aug. 5, 2014

(87) PCT Pub. No.: WO2013/135396

PCT Pub. Date: Sep. 19, 2013

(65) Prior Publication Data

US 2014/0377471 A1 Dec. 25, 2014

(30) Foreign Application Priority Data

Mar. 14, 2012 (EP) ..... 12159365

(51) Int. Cl.

| | |
|---|---|
| ***C23C 18/34*** | (2006.01) |
| ***C23C 18/36*** | (2006.01) |
| ***C23C 18/50*** | (2006.01) |
| ***C23C 18/16*** | (2006.01) |

(52) U.S. Cl.

CPC ..... *C23C 18/50* (2013.01); *C23C 18/1633* (2013.01)

USPC ..... 106/1.22; 106/1.27

(58) Field of Classification Search

CPC ..... C23C 18/50; C23C 18/34; C23C 18/36; C23C 18/1633; B05D 1/18

USPC ..... 106/1.22, 1.27; 427/430.1; 427/437, 427/443.1

See application file for complete search history.

(56) References Cited

U.S. PATENT DOCUMENTS

| | | | | |
|---|---|---|---|---|
| 2,841,602 | A * | 7/1958 | Brown et al. | 556/119 |
| 3,649,308 | A * | 3/1972 | Gulla et al. | 106/1.22 |
| 3,661,597 | A | 5/1972 | Gulla | |
| 3,717,482 | A | 2/1973 | Gulla et al. | |
| 3,790,392 | A | 2/1974 | Gilano | |
| 4,016,051 | A | 4/1977 | Geldzahler et al. | |
| 4,036,709 | A | 7/1977 | Harbulak | |
| 4,104,137 | A | 8/1978 | Lash et al. | |
| 4,435,254 | A * | 3/1984 | Lemke | 205/275 |
| 4,600,609 | A * | 7/1986 | Leever et al. | 106/1.22 |
| 5,695,810 | A * | 12/1997 | Dubin et al. | 427/437 |
| 7,410,899 | B2 | 8/2008 | Chen et al. | |
| 7,758,681 | B2 * | 7/2010 | Lee et al. | 106/1.22 |
| 2005/0173255 | A1 * | 8/2005 | Bokisa et al. | 205/255 |
| 2006/0283715 | A1 * | 12/2006 | Diaddario et al. | 205/245 |
| 2010/0116675 | A1 * | 5/2010 | Sklar et al. | 205/103 |

FOREIGN PATENT DOCUMENTS

EP 1489201 A2 * 12/2004

OTHER PUBLICATIONS

Derwent Abstract of EP 1489201 A2; Dec. 2004.*
PCT/EP2013/050287; PCT International Search Report and Written Opinion of the International Searching Authority dated Mar. 26, 2014.

* cited by examiner

*Primary Examiner* — Helene Klemanski
(74) *Attorney, Agent, or Firm* — Renner, Otto, Boisselle & Sklar, LLP

(57) ABSTRACT

The present invention relates to aqueous, alkaline plating bath compositions for electroless deposition of ternary and quaternary cobalt alloys Co-M-P, Co-M-B and Co-M-B—P, wherein M is selected from the group consisting of Mn, Zr, Re, Mo, Ta and W which comprise a propargyl derivative as the stabilizing agent. The cobalt alloy layers derived there from are useful as barrier layers and cap layers in electronic devices such as semiconducting devices, printed circuit boards, and IC substrates.

9 Claims, No Drawings

ALKALINE PLATING BATH FOR ELECTROLESS DEPOSITION OF COBALT ALLOYS

The present application is a U.S. National Stage Application based on and claiming benefit and priority under 35 U.S.C. §371 of International Application No. PCT/EP2013/050287, filed 9 Jan. 2013, which in turn claims benefit of and priority to European Application No. 12159365.1, filed 14 Mar. 2012, the entirety of each of which is hereby incorporated herein by reference.

FIELD OF THE INVENTION

The present invention relates to aqueous, alkaline plating bath compositions for electroless deposition of ternary and quaternary cobalt alloys. The cobalt alloys deposited from such plating baths are useful as barrier and cap layers in semi-conducting devices, printed circuit boards, IC substrates and the like.

BACKGROUND OF THE INVENTION

Barrier layers are used in electronic devices such as semi-conducting devices, printed circuit boards, IC substrates and the like to separate layers of different composition and thereby prevent undesired diffusion between such layers of different composition.

Typical barrier layer materials are binary nickel alloys such as Ni—P alloys which are usually deposited by electroless plating onto a first layer of a first composition followed by deposition of a second layer of a second composition onto the barrier layer.

Another application of barrier layer materials in electronic devices is as a cap layer which is e.g. deposited onto copper to prevent corrosion of copper.

Ternary and quaternary cobalt alloys became of interest as barrier layers or cap layers because of a better barrier functionality compared to binary nickel alloys. Said cobalt alloys are also deposited by electroless plating.

An aqueous, alkaline plating bath for deposition of ternary and quaternary cobalt alloys comprising polyphosphoric acid or salts thereof as a grain refiner is disclosed in U.S. Pat. No. 7,410,899 B2.

An electroless plating bath for deposition of cobalt-based alloys useful as cap layers is disclosed in WO 2007/075063 A1. The plating bath compositions disclosed therein comprise a phosphorous precursor selected from phosphates and hydrogen phosphates, and dimethylamine borane or borohydride as reducing agent. Stabilising agents employed are one or more of imidazole, thiazole, triazole, disulfide and their derivatives.

A plating solution for electroless deposition of cobalt comprising a combination of mercury ions as a primary stabilizing agent and an acetylenic compound such as propargyl alcohol as a secondary stabilizing agent is disclosed in U.S. Pat. No. 3,717,482. The metallic deposit obtained from such a plating bath composition contains mercury.

The patent document U.S. Pat. No. 3,790,392 discloses plating bath compositions comprising formaldehyde as the reducing agent and a propargyl-type additive for electroless deposition of copper metal.

Plating bath compositions comprising formaldehyde as the reducing agent and a polyether adduct of an alkine alcohol and an alkylene oxide for electroless deposition of copper metal are disclosed in U.S. Pat. No. 3,661,597.

The patent document U.S. Pat. No. 4,036,709 discloses acidic plating bath compositions comprising a reaction product of epoxides with alpha-hydroxy acetylenic alcohols for deposition of cobalt alloys by electroplating.

Acidic plating bath compositions comprising diethylaminopropyne sulfate for electroplating of cobalt or nickel-cobalt alloys are disclosed in U.S. Pat. No. 4,016,051.

The patent document U.S. Pat. No. 4,104,137 discloses acidic plating solutions comprising acetylenically unsaturated sulfonates for electroplating of iron-cobalt alloys. Co—W—P alloy barrier layers having a tungsten content in the range of 0.06 to 0.2 wt. —% are disclosed in U.S. Pat. No. 5,695,810. The plating bath disclosed further comprises 50 mg/l polyethoxynonylphenyl-ether-phosphate.

OBJECTIVE OF THE INVENTION

It is the objective of the present invention to provide an electroless plating bath for deposition of ternary and quaternary cobalt alloys Co-M-P, Co-M-B and Co-M-B—P which has a high stability against undesired decomposition.

SUMMARY OF THE INVENTION

This objective is solved with an aqueous, alkaline plating bath composition for electroless deposition of ternary and quaternary cobalt alloys Co-M-P, Co-M-B and Co-M-B—P, wherein M is preferably selected from the group consisting of Mn, Zr, Re, Mo, Ta and W, the plating bath comprising (i) a source of cobalt ions, (ii) a source of M ions, (iii) at least one complexing agent, (iv) at least one reducing agent selected from the group consisting of hypophosphite ions and borane-based reducing agents, and (v) a stabilising agent according to formula (1):

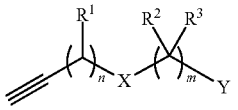

(1)

wherein X is selected from O and $NR^4$, n preferably ranges from 1 to 6, more preferably from 1 to 4, m preferably ranges from 1 to 8, more preferably from 1 to 4; $R^1$, $R^2$, $R^3$ and $R^4$ are independently selected from hydrogen and $C_1$ to $C_4$ alkyl; Y is selected from $SO_3R^5$, $CO_2R^5$ and $PO_3R^5{}_2$, and $R^5$ is selected from hydrogen, sodium, potassium and ammonium.

The electroless plating bath according to the present invention has a high stability against undesired decomposition and allows to depositing ternary and quaternary cobalt alloy layers having a high content of the alloying metal M in the range of 4 to 20 wt. —%.

DETAILED DESCRIPTION OF THE INVENTION

The aqueous, alkaline plating bath of the present invention comprises a water-soluble cobalt salt as a source of cobalt ions. Suitable sources of cobalt ions are for example $CoCl_2$ and $CoSO_4$ and their respective hydrates such as $CoSO_4.7H_2O$.

The concentration of cobalt ions in the plating bath preferably ranges from 0.01 to 0.2 mol/l, more preferably from 0.05 to 0.15 mol/l.

Suitable sources of M ions are selected from the group consisting of water soluble compounds providing Mn, Zr, Re, Mo, Ta and W ions. The most preferred M ions are Mo and W. The preferred sources of M ions are water soluble molybdates and wolframates such as $Na_2MoO_4$ and $Na_2WO_4$ and their respective hydrates such as $Na_2MoO_4.2H_2O$ and $Na_2WO_4.2H_2O$.

The amount of M ions added to the plating bath preferably ranges from 0.01 to 0.2 mol/l, more preferably from 0.05 to 0.15 mol/l. The amount of M ions in the plating bath may be sufficient to reach a concentration of 4 to 20 wt. —% M in the deposited ternary or quaternary cobalt alloy.

A complexing agent or a mixture of complexing agents is included in the plating bath for deposition of ternary and quaternary cobalt ions. The complexing agents are also referred to in the art as chelating agents.

In one embodiment, carboxylic acids, hydroxyl carboxylic acids, aminocarboxylic acids and salts of the aforementioned or mixtures thereof may be employed as complexing or chelating agents. Useful carboxylic acids include the mono-, di-, tri- and tetra-carboxylic acids. The carboxylic acids may be substituted with various substituent moieties such as hydroxy or amino groups and the acids may be introduced into the plating bath as their sodium, potassium or ammonium salts. Some complexing agents such as acetic acid, for example, may also act as a pH buffering agent, and the appropriate concentration of such additive components can be optimised for any plating bath in consideration of their dual functionality.

Examples of such carboxylic acids which are useful as the complexing or chelating agents in the plating bath of the present invention include: monocarboxylic acids such as acetic acid, hydroxyacetic acid (glycolic acid), aminoacetic acid (glycine), 2-amino propanoic acid, (alanine); 2-hydroxy propanoic acid (lactic acid); dicarboxylic acids such as succinic acid, amino succinic acid (aspartic acid), hydroxy succinic acid (malic acid), propanedioic acid (malonic acid), tartaric acid; tricarboxylic acids such as 2-hydroxy-1,2,3 propane tricarboxylic acid (citric acid); and tetracarboxylic acids such as ethylene diamine tetra acetic acid (EDTA). In one embodiment, mixtures of two or more of the above complexing/chelating agents are utilised in the plating bath according to the present invention.

The concentration of the complexing agent or, in case more than one complexing agent is used, the concentration of all complexing agents together preferably ranges from 0.01 to 0.3 mol/l, more preferably from 0.05 to 0.2 mol/l.

In case a hypophosphite compound is used as the reducing agent, a ternary Co-M-P alloy deposit is obtained. A borane-based compound as reducing agent leads to a ternary Co-M-B alloy deposit and a mixture of hypophosphite and borane-based compounds as the reducing agents leads to a quaternary Co-M-B—P alloy deposit.

In one embodiment of the present invention, the plating bath contains hypophosphite ions derived from hypophosphorous acid or a bath soluble salt thereof such as sodium hypophosphite, potassium hypophosphite and ammonium hypophosphite as reducing agent.

The concentration of hypophosphite ions in the plating bath preferably ranges from 0.01 to 0.5 mol/l, more preferably from 0.05 to 0.35 mol/l.

In another embodiment of the present invention the plating bath contains a borane-based reducing agent. Suitable borane-based reducing agents are for example dimethylamine borane and water-soluble borohydride compounds such as $NaBH_4$.

The concentration of the borane-based reducing agent preferably ranges from 0.01 to 0.5 mol/l, more preferably from 0.05 to 0.35 mol/l.

In still another embodiment of the present invention, a mixture of hypophosphite ions and a borane-based reducing agent is employed in the plating bath.

The stabilising agent is selected from compounds according to formula (1):

(1)

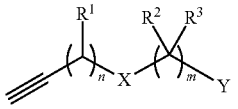

wherein X is selected from O and $NR^4$, n preferably ranges from 1 to 6, more preferably from 1 to 4, m preferably ranges from 1 to 8, more preferably form 1 to 4; $R^1$, $R^2$, $R^3$ and $R^4$ are independently selected from hydrogen and $C_1$ to $C_4$ alkyl; Y is selected from $SO_3R^5$, $CO_2R^5$ and $PO_3R^5{}_2$, and $R^5$ is selected from hydrogen, sodium, potassium and ammonium.

More preferably, the stabilising agent is selected from compounds according to formula (1) wherein Y is $SO_3R^5$ with $R^5$ selected from hydrogen, sodium, potassium and ammonium.

The stabilising agent according to formula (1) is required to extend the life time of the plating bath according to the present invention and prevents undesired decomposition of the plating bath.

The concentration of the stabilising agent according to formula (1) preferably ranges from 0.05 to 5.0 mmol/l, more preferably from 0.1 to 2.0 mmol/l.

Ions of the toxic heavy metal elements lead, thallium, cadmium and mercury are not contained in the electroless plating bath composition according to the present invention.

Other materials may be included in the plating bath according to the present invention such as pH buffers, wetting agents, accelerators, brighteners, etc. These materials are known in the art.

The electroless plating bath for deposition of ternary and quaternary cobalt alloys can be prepared by adding ingredients (i) to (v) to water. Alternatively, a concentrate of the plating bath is prepared and further diluted with water prior to use for plating operations.

The electroless plating bath according to the present invention preferably has a pH value of 7.5 to 12, more preferably of 8 to 11.

Substrates to be coated with a ternary or quaternary cobalt alloy from the plating bath according to the present invention are cleaned (pre-treated) prior to cobalt alloy deposition. The type of pre-treatment depends on the substrate material to be coated.

Copper or copper alloy surfaces are treated with an etch cleaning method which is usually carried out in oxidizing, acidic solutions, for example a solution of sulfuric acid and hydrogen peroxide. Preferably, this is combined by another cleaning in an acidic solution, such as, for example, a sulfuric acid solution which is either used prior or after etch cleaning.

For a pre-treatment of aluminum and aluminum alloys different zincations are available, for example Xenolyte® cleaner ACA, Xenolyte® Etch MA, Xenolyte® CFA or Xenolyte® CF (all available from Atotech Deutschland GmbH) which fulfil the industry standards of cyanide-free chemistry. Such pre-treatment methods for aluminum and aluminum alloys are for example disclosed in U.S. Pat. No. 7,223,299 B2.

For the purpose of the present invention it can be useful to apply an additional activation step to the substrate metal or metal alloy surface prior to depositing the ternary or quaternary cobalt alloy layer. Such an activation solution can comprise a palladium salt which results in a thin palladium layer. Such a palladium layer is very thin and usually does not cover the entire copper or copper alloy surface. It is not considered a distinct layer of the layer assembly but rather an activation, which forms a metal seed layer. Such seed layer is typically a few angstroms in thickness. Such a seed layer is plated to the copper or copper alloy layer by an immersion exchange process.

Surface activation with e.g., a palladium seed layer is also suitable if a ternary or quaternary cobalt alloy layer is to be deposited from the plating bath according to the present invention onto a dielectric surface, such as a silica surface.

Next, the ternary or quaternary cobalt alloy selected from Co-M-P, Co-M-B and Co-M-B—P alloys is deposited onto the activated substrate surface by electroless plating. M is preferably selected from the group consisting of Mn, Zr, Re, Mo, Ta and W. The ternary or quaternary cobalt alloy is more preferably selected from the group consisting of Co—Mo—P, Co—W—P, Co—Mo—B, Co—W—B, Co—Mo—B—P and Co—W—B—P alloys. The most preferable cobalt alloys are Co—Mo—P and Co—W—P alloys.

The ternary or quaternary cobalt alloy is deposited onto the pre-treated substrate surface by immersing the substrate in the plating bath according to the present invention. Suitable methods for immersing are dipping the substrate into the plating bath or spraying the plating bath onto the substrate surface. Both methods are known in the art. Preferably, the plating bath is held at a temperature in the range of 20 to 95° C., more preferably in the range of 50 to 90° C. The plating time depends on the thickness of the ternary or quaternary cobalt alloy layer to be achieved and is preferably 1 to 60 min.

The ternary or quaternary cobalt alloy layer deposited from the plating bath according to the present invention preferably has a thickness in the range of 0.03 to 5.0 μm, more preferably of 0.1 to 3.0 μm.

The following non-limiting examples further illustrate the present invention.

EXAMPLES

Preparation Example 1

Preparation of 3-(prop-2-ynyloxy)-propyl-1-sulfonate-sodium salt (compound according to formula (1) with n=3, m=3, $R^1$, $R^2$ and $R^3$=H, X=O and Y=sulfonate with $R^4$=sodium):

1.997 g (49.9 mmol) sodium hydride was suspended in 70 ml THF under Argon. To this reaction mixture 2.830 g (49.9 mmol) prop-2-yn-1-ol was added drop wise at ambient temperature.

After finishing the hydrogen evolution 6.1 g (49.9 mmol) 1,2-oxathiolane-2,2-dioxide dissolved in 15 ml THF was added drop wise at ambient temperature. After addition the reaction mixture was stirred for additional 12 hours and the THF removed under vacuum. The solid residue was extracted with ethyl acetate and filtrated. The solid was dried under vacuum.

9.0 g (44.9 mmol) of a yellowish solid were obtained (90% yield).

Preparation Example 2

Preparation of 3-(prop-2-ynylamino)-propyl-1-sulfonate-sodium salt (compound according to formula (1) with n=3, m=3, $R^1$, $R^2$ and $R^3$=H, X=NH, and Y=$SO_3R^5$ with $R^5$=sodium):

4 g (71.2 mmol) prop-2-yn-1-amine were dissolved in 75 ml THF and cooled to 0° C. To this mixture 8.87 g (71.2 mmol) 1,2-oxathiolane 2,2,-dioxide dissolved in 25 ml THF were added drop wise at 0° to 5° C. After addition the reaction mixture was heated to room temperature and stirred for 12 hours. The occurring beige-colored crystals were filtrated and washed with 10 ml THF and 10 ml ethanol. The solid was dried under vacuum.

10.2 g (57.6 mmol) of a beige colored solid were obtained (81% yield).

Determination of the Stability Number of Electroless Plating Baths:

250 ml of the plating bath under consideration were heated to 80±1° C. in a 500 ml glass beaker while stirring. Next, 1 ml of a palladium test solution (20 mg/l palladium ions in deionized water) was added every 30 s to the plating bath. The test is finished when a gray precipitate associated with gas bubbles is formed in the plating bath which indicates the undesired decomposition of the plating bath.

The stability number achieved for the plating bath under consideration corresponds to the volume of palladium test solution in increments of 1 ml added to the plating bath until formation of the gray precipitate.

Respective stabilising agents in examples 1 and 4 were added to an aqueous plating bath stock solution comprising

| | | |
|---|---|---|
| $CoSO_4 \cdot 7H_2O$ | 32.9 g/l | 0.1 mol/l |
| $Na_2WO_4 \cdot 2H_2O$ | 32.9 g/l | 0.1 mol/l |
| Tri-sodium citrate dihydrate | 58.8 g/l | 0.15 mol/l |
| Sodium hypophosphite monohydrate | 30 g/l | 0.22 mol/l |

Example 1 (Comparative)

The stability number of the aqueous plating bath stock solution without any stabilising agent is 6.

Example 2 (Comparative)

0.4 mg/l of lead ions were added to the plating bath stock solution as the stabilising agent. Lead ions are a typical stabilising agent used in electroless plating baths.

The stability number of the plating bath is 20.

Example 3

140 mg/1 of 3-(prop-2-ynyloxy)-propyl-1-sulfonate-sodium salt obtained from preparation example 1 were added as the stabilising agent.

The stability number of the plating bath is 20.

Hence, stabilising agents according to formula (1) are suitable stabilising agents for aqueous, alkaline plating baths for electroless deposition of ternary and quaternary cobalt alloys.

Example 4

50 mg/l of 3-(prop-2-ynylamino)-propyl-1-sulfonate-sodium salt (obtained from preparation example 2) was added as the stabilising agent.

The stability number of the plating bath is 20.

The invention claimed is:

1. An aqueous, alkaline plating bath composition for electroless deposition of ternary and quaternary cobalt alloys Co-M-P, Co-M-B and Co-M-B—P, wherein M is selected from the group consisting of Mn, Zr, Re, Mo, Ta and W, the plating bath comprising (i) a source of cobalt ions, (ii) a source of M ions, (iii) at least one complexing agent selected from the group consisting of carboxylic acids, hydroxyl carboxylic acids, aminocarboxylic acids and salts of the aforementioned and wherein the concentration of the at least one complexing agent ranges from 0.01 to 0.3 mol/l, (iv) at least one reducing agent selected from the group consisting of hypophosphite ions, borane-based reducing agents, and mixtures thereof, and (v) a stabilising agent according to formula (1):

(1)

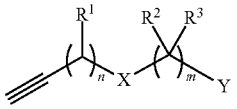

wherein X is selected from O and $NR^4$, n ranges from 1 to 6, m ranges from 1 to 8; $R^1$, $R^2$, $R^3$ and $R^4$ are independently selected from hydrogen and $C_1$ to $C_4$ alkyl; Y is selected from $SO_3R^5$, $CO_2R^5$ and $PO_3R^5{}_2$, and $R^5$ is selected from hydrogen, sodium, potassium and ammonium wherein the concentration of the stabilising agent according to formula (1) ranges from 0.05 to 5.0 mmol/l.

2. The aqueous, alkaline plating bath according to claim 1 wherein Y is $SO_3R^5$ with $R^5$ selected from hydrogen, sodium, potassium and ammonium.

3. The aqueous, alkaline plating bath according to claim 1 wherein the plating bath has a pH value of 7.5 to 12.

4. The aqueous, alkaline plating bath according to claim 1 wherein the concentration of cobalt ions ranges from 0.01 to 0.2 mol/l.

5. The aqueous, alkaline plating bath according to claim 1 wherein the concentration of the M ions ranges from 0.01 to 0.2 mol/l.

6. The aqueous, alkaline plating bath according to claim 1 wherein M is selected from the group consisting of Mo and W.

7. The aqueous, alkaline plating bath according to claim 1 wherein the concentration of the at least one reducing agent ranges from 0.01 to 0.5 mol/l.

8. The aqueous, alkaline plating bath according to claim 1 wherein the at least one reducing agent are hypophosphite ions.

9. A method for electroless deposition of ternary and quaternary cobalt alloys Co-M-P, Co-M-B and Co-M-B—P, wherein M is selected from the group consisting of Mn, Zr, Re, Mo, Ta and W comprising, in this order, the steps (i) Providing a substrate, (ii) Immersing the substrate in the aqueous, alkaline plating bath according to claim 1, and thereby depositing a ternary or quaternary cobalt alloy Co-M-P, Co-M-B and Co-M-B—P, wherein M is selected from the group consisting of Mn, Zr, Re, Mo, Ta and W onto the substrate.

* * * * *